United States Patent [19]

Rudholm

[11] Patent Number: 4,727,628

[45] Date of Patent: Mar. 1, 1988

[54] STRAP BUCKLE WITH SELF-LOCKING FUNCTION

[75] Inventor: Göran Rudholm, Boråas, Sweden

[73] Assignee: Rudholm & Co. i Boras AB, Boråas, Sweden

[21] Appl. No.: 74,489

[22] PCT Filed: Oct. 23, 1986

[86] PCT No.: PCT/SE86/00489

§ 371 Date: Jun. 30, 1987

§ 102(e) Date: Jun. 30, 1987

[87] PCT Pub. No.: WO87/02552

PCT Pub. Date: May 7, 1987

[30] Foreign Application Priority Data

Oct. 24, 1985 [SE] Sweden ..... 8505015

[51] Int. Cl.[4] ..... A44B 11/12

[52] U.S. Cl. ..... 24/170; 24/191

[58] Field of Search ..... 24/170, 191, 178, 188, 24/17 R, 18

[56] References Cited

U.S. PATENT DOCUMENTS

| | | | |
|---|---|---|---|
| 511,310 | 12/1893 | Pugh | 24/170 |
| 828,321 | 8/1906 | Kimberly | 24/191 |
| 906,391 | 12/1908 | Dickson et al. | 24/170 |
| 939,394 | 11/1909 | Cohen | 24/191 |
| 982,433 | 1/1911 | Knight et al. | 24/170 |
| 1,398,126 | 11/1921 | Cochrane | 24/170 |
| 2,227,768 | 1/1941 | Stark | 24/170 |
| 2,618,827 | 11/1952 | Hora | 24/170 |
| 3,328,856 | 7/1967 | Jonas | 24/191 |

FOREIGN PATENT DOCUMENTS

| | | | |
|---|---|---|---|
| 128584 | 2/1901 | Fed. Rep. of Germany | 24/170 |

*Primary Examiner*—Victor N. Sakran

*Attorney, Agent, or Firm*—Cushman, Darby & Cushman

[57] ABSTRACT

A strap buckle with self-locking function, incorporating a frame shaped holder (15) with a shaft (1) extending laterally to the inner of the frame, which shaft carries a double-armed locking member (12), pivotably against the action of a resilient member, which locking member is adapted to cooperate with end gable (21) of the frame, thereby locking a part (19) of a strap between the locking member (12) and said end gable, whereby, for the purpose of providing a simple, easily assembled and reliable strap buckle, both arms (20,22) of the two-armed locking member (12) are situated inside the outer frame (18,21) of the holder (15), and the locking member (12) is provided with a central non-round, oblong transverse groove (13), and that the shaft (11) has a non-round, elongated cross-sectional shape corresponding to that of the groove (13), whereas the resilient member is an integral part of the locking member (12), where the portions (25) about the groove (13) are elastically resilient, and the holder (15) as well as the locking member (12) are manufactured from plastic material and are held together solely by that the locking member with its groove (13) is fixed by being pivotably snapped upon the shaft (11) of the holder.

1 Claim, 3 Drawing Figures

STRAP BUCKLE WITH SELF-LOCKING FUNCTION

The present invention refers to a strap buckle with self-locking function incorporating a frame shaped holder with a shaft provided between the opposite inner long sides of the frame, about which shaft is pivotably supported a double-armed locking member, which is adapted to cooperate with one end gable of the frame, thereby locking a part of a strap situated between the locking member and said end gable, and which locking member under actuation of an external force is pivotable about the shaft against action of a resilient member.

BACKGROUND OF THE INVENTION

At strap buckles intended for interconnecting two strap or belt parts, e.g. in clothes, leisure equipment such as safety jackets, packages etcetera, it is a desire, that the lock has a self-locking function, i.e. that it arrests the strap part arranged therein for as long as the lock is unaffected by external forces.

This self-locking is commonly effected by a locking member arranged in conventional manner upon a shaft, which locking member is biased by a spring to be pressed against locking position, when unaffected.

This, being the predominant type of clamps or strap buckles of this kind, has drawbacks in that they consist of at least three main parts, which at assembly require a considerably cost-increasing manual work, as the three main parts, one of which is usually a metallic spring, can hardly be assembled in automatic machines. The spring furthermore must be of a high-quality metallic material in order not to suffer from fatigue after a period of use or becoming damaged e.g. from salt water or at washing together with an article of clothing.

From U.S. Pat. No. 1,398,126 is earlier known a clamp, wherein this common principle has been abandoned and this clamp comprises a frame-shaped holder with a shaft arranged between the opposite inner long sides of the frame, about which shaft is pivotably supported a double-armed locking member, which is arranged to cooperate with one end gable of the frame, thereby locking a part of a strap situated between the locking member and said end gable, and which locking member under actuation of an external force is pivotable about the shaft against the action of a resilient member. The transverse shaft is located at the side of the holder facing away from the end gable cooperating with the locking member and it has an oval cross-section. The resilient member consists of a central stamped-out tounge in the locking member, which on the other side of the shaft projects outside the holder. When opening the locking member the bigger diameter of the oval shaft hereby will force the tounge away from the other portions of the locking member and produce a force, striving to pivot the locking member to locking position. Due to the open design there however is a risk that the locking member can fall off the shaft, when the member is in open position. It furthermore must be considered highly probable that the stamped-out tounge after a rather small number of opening and closing movements may be deformed and/or fatigued so much that it can not guarantee a satisfactory locking effect. The design, where one arm of the locking member projects outside the frame, finally means that particular conditions are required for a strap buckle of this type to be locked and opened resp. when in stretched condition, as one of the two locking member arms at opening or locking movement must move past the plane of the holder, inwards against the object around which the strap is locked. This is impractical but possible when it concerns soft, deformable objects, as e.g. the waist of a human being, but not if the surface upon which the strap is arranged is stiff, undeformable.

THE PURPOSE AND MOST ESSENTIAL FEATURES OF THE INVENTION

The purpose of the present invention is to provide a strap buckle of the type mentioned in the introductory part of the specification, which consists of a minimum of parts easily assembled in automatic machines and which also in other respects eliminates the above-mentioned drawbacks of earlier strap buckles, and this has been achieved in that both arms of the two-armed locking member are situated inside the outer frame of the holder, that the locking member is provided with a transverse groove arranged between its arms and having a non-round, oblong cross-section, that the shaft is designed with a non-round, elongated cross-sectional shape mainly corresponding to that of the groove, that the resilient member is an integral part of the locking member, whereby the portions about the groove are elastically resilient, and that the holder as well as the locking member are manufactured from plastic material and are held together solely by that the locking member with its groove is fixed by being snapped upon the shaft of the holder.

DESCRIPTION OF THE DRAWINGS

The invention hereinafter will be further described with reference to an embodiment shown in the accompanying drawing.

DESCRIPTION OF EMBODIMENT

The strap buckle according to the invention principally consists of two components, one of which being a shaft 11 and the other one a part 12 being pivotable about the shaft and being provided with a recess 13 for receiving the shaft 11.

Figure 1:
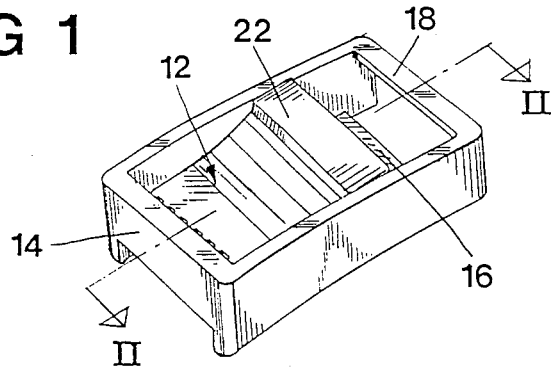
FIG. 1 shows in perspective a strap buckle according to the invention.
Figure 2:
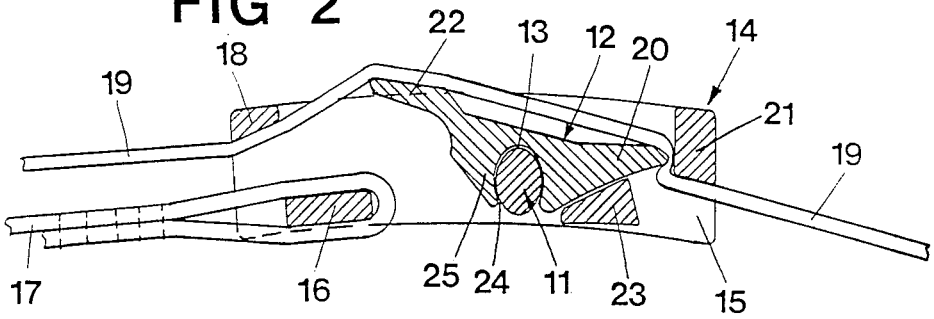
FIG. 2 shows a section along line II—II in FIG. 1, with straps thread into the strap buckle.
Figure 3:
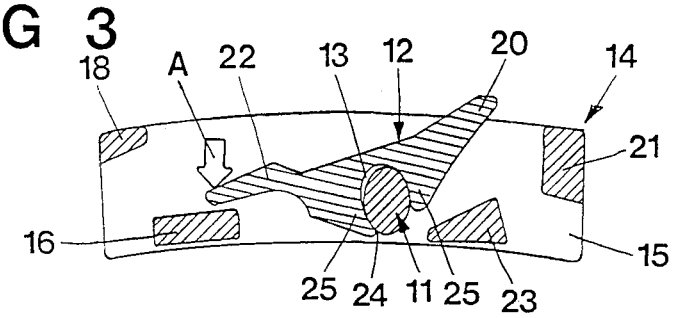
FIG. 3 is a section analogous with FIG. 2 with the locking arm in a position acted upon by an external force.

Such as shown in FIGS. 1, 2 and 3 the shaft 11 is fixedly attached with its end portions to the frame-shaped holder is of the strap buckle 14 at two inner opposed frame sides and spaced apart from the end gables of the holder. In parallel with the shaft 11, there is provided, in a manner known per se, a first bar 16, as an attachment for one end of a strap 17. At some distance from the first bar 16 there is provided a second bar 18 forming one end gable of the frame 15 and which together with the first bar 16 forms a buckle for another strap end 19. The other part 12 is designed as a two-armed locking member, one arm 20 of which is designed and arranged under locking to press the strap 19 against the other end gable 21 of the holder 15. The two arms 20,22 of the locking member 12 are situated within the outer frame 18,21 of the holder 15, and its other locking arm 22 is designed as an actuating device, by means of which the locking member under influence of a force, which in FIG. 3 is shown with the arrow A, can be pivoted about the shaft 11. A further bar 23 arranged at a small distance from the end gable 21 is intended to serve as a locking shoulder for limitation of the pivoting movement of the locking member and also as a reinforcement for the frame structure 15 and furthermore to form, together with the end gable 21, a buckle for the strap part 19 therein.

In this embodiment the recess 13 of the locking member 12 has a non-round cross-section, e.g. oval, whereas the shaft 11 also has an oval cross-sectional shape corresponding to that of the recess. The recess 13 is preferably constituted by a laterally open groove, the longitudinal opening 24 of which is more narrow than the biggest inner width of the groove. The groove of the locking member in this manner can be snapped over the shaft 11, and the holder 15 and the locking member 12 are thereupon held assembled by said snap connection only, this being possible as the locking member is elastically resilient, made e.g. from acetal plastic, which allows the shanks 25 on both sides of the recess 13 to flex apart when the locking member is pushed up on the shaft and when the lockin member is pivoted, such as shown in FIG. 3. As soon as the force A upon the locking arm 22 ceases, the elastic force in the shanks 25 will move the locking member back to its initial position according to FIG. 2, whereby the strap 19 is locked between the locking member arm 20 and the holder end gable 21.

The invention is not limited to the embodiment shown but a plurality of variants are possible within the scope of the claims.

I claim:

1. A strap buckle with self-locking function, incorporating a frame shaped holder (15) with a shaft (11) provided between the opposite inner long sides of the frame, about which shaft is pivotably supported a double-armed locking member (12), which is adapted to cooperate with one end gable (21) of the frame, thereby locking a part (19) of a strap situated between the locking member (12) and said end gable, and which locking member under actuation of an external force (A) is pivotable about the shaft against the action of a resilient member, characterized therein, that both arms (20,22) of the two-armed locking member (12) are situated inside the outer frame (18,21) of the holder (15), that the locking member (12) is provided with a transverse groove (13) arranged between its arms (20,22) and having a non-round, oblong cross-section, that the shaft (11) is designed with a non-round, elongated cross-sectional shape mainly corresponding to that of the groove (13), that the resilient member is an integral part of the locking member (12), whereby the portions (25) about the groove (13) are elastically resilient, and that the holder (15) as well as the locking member (12) are manufactured from plastic material and are held together solely by that the locking member with its groove (13) is fixed by being snapped upon the shaft (11) of the holder.

* * * * *